US008814323B2

(12) United States Patent
Li et al.

(10) Patent No.: US 8,814,323 B2
(45) Date of Patent: Aug. 26, 2014

(54) INKJET PRINTER MAINTENANCE ARRANGEMENT AND METHOD

(71) Applicant: Delphax Technologies Inc., Bloomington, MN (US)

(72) Inventors: Ke Li, Hamilton (CA); Christopher Thomson, Etobicoke (CA)

(73) Assignee: Delphax Technologies Inc., Bloomington, MN (US)

( * ) Notice: Subject to any disclaimer, the term of this patent is extended or adjusted under 35 U.S.C. 154(b) by 0 days.

(21) Appl. No.: 13/745,881

(22) Filed: Jan. 21, 2013

(65) Prior Publication Data

US 2013/0293633 A1 Nov. 7, 2013

Related U.S. Application Data

(60) Provisional application No. 61/642,412, filed on May 3, 2012.

(51) Int. Cl.
*B41J 2/165* (2006.01)

(52) U.S. Cl.
CPC ..... *B41J 2/16511* (2013.01); *B41J 2/16585* (2013.01)
USPC ..... 347/32

(58) Field of Classification Search
CPC ..... B41J 2/16511; B41J 2/16585
USPC ..... 347/32
See application file for complete search history.

(56) References Cited

U.S. PATENT DOCUMENTS

| | | | | |
|---|---|---|---|---|
| 4,045,802 | A * | 8/1977 | Fukazawa et al. | 347/29 |
| 5,040,000 | A * | 8/1991 | Yokoi | 347/30 |
| 5,548,310 | A * | 8/1996 | Binnert et al. | 347/33 |
| 2006/0119649 | A1 * | 6/2006 | Berry et al. | 347/32 |
| 2009/0237443 | A1 | 9/2009 | Miramanda et al. | |

FOREIGN PATENT DOCUMENTS

| | | | |
|---|---|---|---|
| EP | 0589604 | A2 | 3/1994 |
| EP | 1238807 | A1 | 9/2002 |

* cited by examiner

*Primary Examiner* — Stephen Meier
*Assistant Examiner* — Alexander D Shenderov
(74) *Attorney, Agent, or Firm* — Stuart L. Wilkinson

(57) ABSTRACT

Inkjet printing apparatus has a printhead mounted on a printer carriage and a maintenance assembly mounted on a maintenance carriage. Media are transported to the printhead for printing. To prepare for maintenance operations, a printer drive unit drives the printhead carriage between a printing position and a printer parked position where it is spaced from the printhead. A maintenance drive unit drives the maintenance assembly between a maintenance assembly and a position next to the printhead where it occupies the space vacated by the printhead.

1 Claim, 10 Drawing Sheets

INKJET PRINTER MAINTENANCE ARRANGEMENT AND METHOD

CROSS REFERENCE TO RELATED PATENTS

The present U.S. Utility patent application claims priority pursuant to 35 U.S.C. §119(e) to U.S. Provisional Patent Application Ser. No. 61/642,412, entitled "INKJET PRINTER MAINTENANCE ARRANGEMENT AND METHOD," filed May 3, 2012.

FIELD OF THE INVENTION

This invention relates to an inkjet printer maintenance arrangement and is particularly applicable to industrial grade printers having an inkjet printhead which extends the full width of sheet media to be printed.

BACKGROUND OF THE INVENTION

As is well-known, inkjet printers operate by ejecting droplets of ink onto a web or sheet medium. Such printers have printheads that are non-contact heads with ink being transferred during the printing process as minute "flying" ink droplets over a short distance of the order of ½ to 1 millimetre. Modern inkjet printers are generally of the continuous type or the drop-on-demand type. In the continuous type, ink is pumped along conduits from ink reservoirs to nozzles. The ink is subjected to vibration to break the ink stream into droplets, with the droplets being charged so that they can be controllably deflected in an applied electric field. In a thermal drop-on-demand type, a small volume of ink is subjected to rapid heating to form a vapour bubble which expels a corresponding droplet of ink. In piezoelectric drop-on-demand printers, a voltage is applied to change the shape of a piezoelectric material and so generate a pressure pulse in the ink and force a droplet from the nozzle.

Most inkjet printers are designed with scanning printheads. Because of the cost of manufacture, such printheads generally have a small number of nozzles. To print even a small page, the head is moved over the medium and ink droplets are ejected at the appropriate moment to construct the portion of the image being created. As only one band of an image is created in a single scan, the process is quite slow. For industrial grade inkjet printers where printing speeds of the order of 60 pages per minute are sought, inkjet printers have been developed which extend across the full width of sheet media to be printed. Of particular but not exclusive interest in the context of the present invention are thermal drop-on-demand inkjet printheads commercially available under the MEMJET registered trade mark. Such printheads use thermal energy to produce a vapor bubble in ink occupying a channel so as to expel an ink droplet from a nozzle at an exposed end of the channel. The printhead is manufactured as an integrated circuit device to include heating resistors located adjacent to the ink ejection nozzles, the resistors being individually energized by electrical heating pulses in response to an input print signal. For each ink colour or type, a separate ink supply circuit is used having an ink supply container and a peristaltic pump for pumping ink from the container to the printhead. For each ink colour/type, the printhead has an ink inlet port, an ink outlet and a main channel. Ink is drawn from the main channel into branch channels by capillary action to replace ink that is ejected in the course of printing. Printing is enabled by "firing" selected nozzles at the printhead active face. Other than when firing, ink in a nozzle chamber is prevented from escaping from the nozzle and flooding the nozzle plate by maintaining a negative hydrostatic pressure at the printhead. The Memjet printheads have a high nozzle density of the order of 1600 dots per inch (dpi). A series of such integrated circuit devices may be combined to provide a page wide printhead typically having five colour channels. Typically, the preferred Memjet integrated circuit printhead has of the order of 70,000 nozzles. At a paper speed of 12 inches (305 mm) per second, the printhead produces 1600×800 dpi quality, while at a speed of 6 inches (152 mm) per second, the printhead produces 1600×1600 dpi output for high-quality graphics (1-2 picolitres). Ink drop placement is very accurate with ink drops being of the order of 14 microns in diameter. Typically a Memjet IC chip contains 5 ink channels with two rows of nozzles per channel. Preferred Memjet devices have nozzles which are coated with a layer of silicon nitride to provide a smooth, flat surface resisting debris adhesion and so providing for ease of maintenance.

In order to keep an inkjet printhead capable of printing high quality images, certain maintenance procedures are performed during a printing process. Among such procedures is printhead capping which consists of placing a cap over the printhead nozzles when a printing operation is temporarily suspended to ensure that ink at the printhead nozzles does not dry out and cause partial or full blocking of an inkjet nozzle. Another common procedure is printhead cleaning in which ink is ejected though the printhead nozzles to flood the printhead face which is then washed in the ink. In addition, maintenance elements may include a spittoon to receive excess ink that may inadvertently flood the printhead face or may have been deliberately applied to the printhead face in the course of the cleaning process. Conventionally, the maintenance elements are mounted as an assembly, the assembly having an associated drive mechanism to bring appropriate maintenance elements to the print face when required and an ink drain means for draining excess or cleaning ink from the printhead face. Accommodation must be made for such an inkjet maintenance assembly which takes into account the position and operation of the inkjet print engine (of which the inkjet printhead is a primary part) and the inkjet printer sheet media transport mechanism.

A known arrangement of printhead engine and maintenance assembly that is particularly adapted for cut sheets is shown in FIG. 1. The printer has a transport mechanism in which cut sheets are moved through the printer using consecutive nips. At each pair of nips, a first upstream nip grips the sheet and pushes it downstream. Before the sheet has fully left the first nip, a leading edge of the sheet is gripped by a downstream nip which draws it into the downstream nip and then drives it further downstream. In one known arrangement, a plane containing the transport path for the cut sheets extends between an overlying print engine and an underlying maintenance assembly. The print engine and the maintenance assembly are located between consecutive transport mechanism nips and face each other across the transport path. To undertake a maintenance procedure, the printing process is halted at a juncture when no cut sheet medium is occupying that part of the transport path between the two consecutive nips. The particular maintenance element, such as a capper or cleaner is moved up into engagement with the printhead face and the corresponding maintenance procedure is performed.

An alternative transport equipment for transporting cut sheets to and from an inkjet print station disclosed in U.S. patent application Ser. No. 13/368,280 (Multiple printhead printing apparatus and method of operation) filed Feb. 7, 2012, the contents of which are hereby incorporated by reference in their entirety and made part of the present United States patent application for all purposes. The aforesaid application describes a printing apparatus having a series of inkjet printheads spaced from one another in a transport direction. A continuous belt driven around a roller system is used to feed sheet media successively to the printheads so that a partial image printed by one printhead is overprinted at a subsequent printhead with registration of the partial images. A sheet medium is caused to become electrostatically tacked to the belt by passing the sheet past a charging device. Movement of the belt is tracked by a tracking sub-system and operation of the printheads is coordinated with the tracked belt movement to achieve precise registration of the partial images. The nature of this transport system means that every part of the continuous belt tracks under the printheads during the printing process. Consequently, it is not possible to provide access to maintenance elements located underneath the printhead because access is blocked by the conveyor belt.

SUMMARY OF THE INVENTION

According to one aspect of the invention, there is provided apparatus comprising a printhead mounted on a first carriage, a printhead maintenance assembly including first and second maintenance elements, the printhead maintenance assembly mounted on a second carriage, a transport assembly operable to move sheet media past the printhead in a transport direction along a transport path for printing thereon by the printhead, a first reciprocal drive to drive the first carriage between a first position in which the printhead is positioned for printing onto sheet media in the transport path, and a second position in which a space is established between the printhead and the transport path, a second reciprocal drive for driving the second carriage to effect a first phase movement of the second carriage between a third position in which the maintenance assembly is parked at a position allowing printing of transported sheet media by the printhead and a fourth position in which the maintenance assembly occupies the space and the first maintenance element is positioned for performing a maintenance operation on the printhead, and a second phase movement of the second carriage between the fourth position and a fifth position in which the first maintenance element is displaced from its operating position relative to the printhead and the second maintenance element is located in an operating position relative to the printhead, the second reciprocal drive being a belt drive, the belt drive for reciprocally driving the second carriage in a first direction, the belt connected to a motion transfer device to convert a predetermined movement of the belt to movement of the second carriage in a direction transverse to the first direction.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 2A:
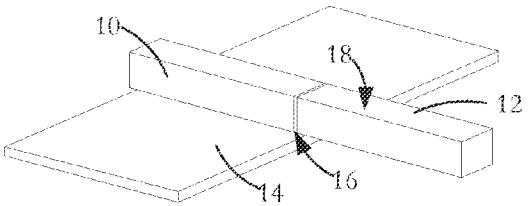
FIG. 2*a* is a perspective view of an inkjet print engine, an inkjet printhead maintenance assembly and a sheet media transport mechanism according to one embodiment of the invention.
Figure 2B:
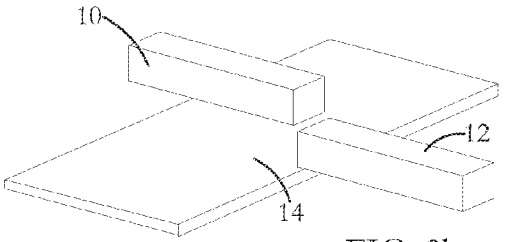
FIG. 2*b* is a perspective view corresponding to FIG. 2*a* but showing the inkjet print engine, the inkjet printhead maintenance assembly and the sheet media transport mechanism at a subsequent juncture in a maintenance cycle.
Figure 2C:
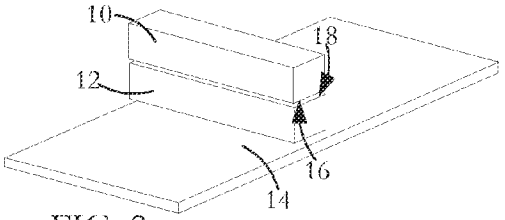
FIG. 2*c* is a view corresponding to FIG. 2*b*, but showing the inkjet print engine, the inkjet printhead maintenance assembly and the sheet media transport mechanism at a subsequent juncture in the maintenance cycle.

Referring in detail to FIGS. 2*a* to 2*c*, there is shown in outline view an inkjet print engine 10 comprising an inkjet printhead within an associated carriage, an inkjet printhead maintenance assembly 12, and a section of a belt 14 forming part of a cut sheet media transport mechanism. The inkjet print engine 10 and the maintenance assembly 12 are mounted on a common support structure which is not shown in FIGS. 2*a* to 2*c* but which is shown in a specific implementation in FIG. 6.

FIG. 2*a* shows the print engine 10 and the maintenance assembly 12 as they are positioned during a printing cycle. The print engine is located with a printhead active face 16 facing the upper face of the sheet media conveyor belt 14. The maintenance assembly 12 is located essentially in line with the printhead 10 but laterally offset to one side of the belt 14. Both the print engine 10 and the maintenance assembly 12 have a width equal to the width of the transport belt 14. Consequently, the printhead 10 can print the full width of sheet media as they are transported under the print engine 10 during a print cycle. In addition, the maintenance assembly 12, which has maintenance elements presented upwardly, can be operated to service the complete printhead 10 when it is brought against the printhead face 16. In this arrangement, an active face 16 of the printhead faces downwardly and maintenance assembly elements shown generally at 18 are presented upwardly.

FIG. 2*b* shows the print engine 10 and the maintenance assembly 12 at a subsequent stage when the printing process has been suspended to allow printhead maintenance to take place. The print engine 10 is raised from the belt 14 to open up a space between the print engine 10 and the belt 14. FIG. 2*c* shows the print engine and the maintenance assembly at a later stage in the preparation for a maintenance cycle. The maintenance assembly 12 is moved into the space so that the printhead face 16 is immediately over the top of, and faces, the upwardly facing maintenance elements 18 of the maintenance assembly 12. In this arrangement, the selected elements of the maintenance assembly 12 are operated to implement desired maintenance operations as will be described in greater detail presently.

Figure 3A:
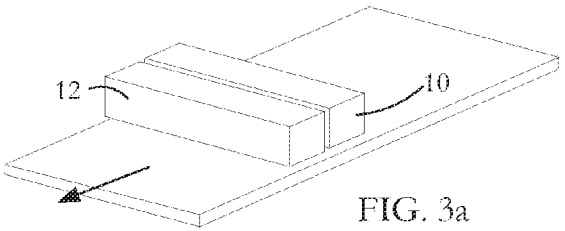
FIG. 3*a* is perspective view of an inkjet print engine, an inkjet printhead maintenance assembly and a sheet media transport mechanism according to another embodiment of the invention.
Figure 3B:
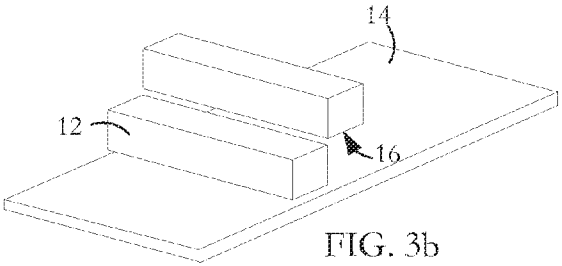
FIG. 3*b* is a perspective view corresponding to FIG. 3*a*, but showing the inkjet print engine, the inkjet printhead maintenance assembly and the sheet media transport mechanism at a subsequent juncture in a maintenance cycle.
Figure 3C:
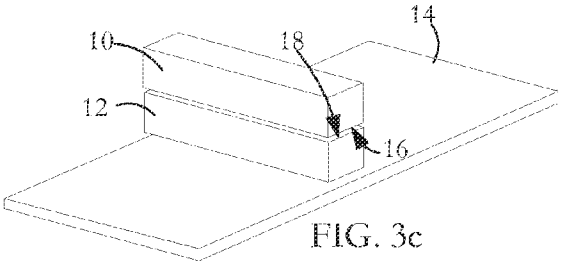
FIG. 3*c* is a view corresponding to FIG. 3*b*, but showing the inkjet print engine, the inkjet printhead maintenance assembly and the sheet media transport mechanism at a subsequent juncture in the maintenance cycle.
Figure 1:
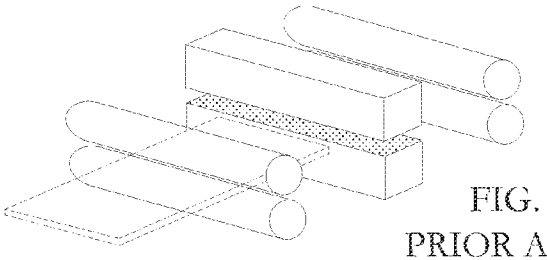
FIG. 1 PRIOR ART
FIG. 1 is a PRIOR ART perspective view of a known arrangement of an inkjet print engine, an inkjet printhead maintenance assembly and a sheet media transport mechanism

A variation on the FIGS. 2*a* to 2*c* embodiment is shown in FIGS. 3*a* to 3*c*. In this embodiment, during printing, the maintenance assembly 12 is positioned downstream of the print engine 10 but positioned over the transport belt 14. When a maintenance procedure is to be implemented, the print engine 10 is again raised to present a space. In this case, the maintenance assembly 12 is driven in the reverse transport direction to a position under the print engine 10 where a selected upwardly facing maintenance element 18 can be engaged at the printhead active face 16.

Figure 4A:
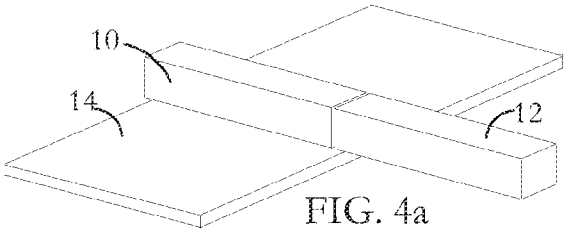
FIG. 4*a* is perspective view of an inkjet print engine, an inkjet printhead maintenance assembly and a sheet media transport mechanism according to a further embodiment of the invention.
Figure 4B:
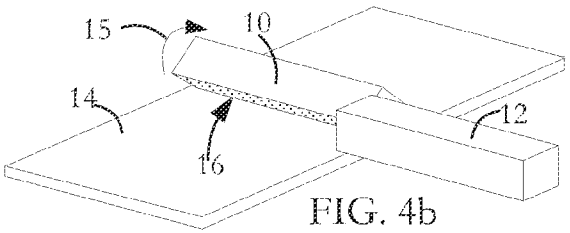
FIG. 4*b* is a perspective view corresponding to FIG. 4*a*, but showing the inkjet print engine, the inkjet printhead maintenance assembly and the sheet media transport mechanism at a subsequent juncture in a maintenance cycle.
Figure 4C:
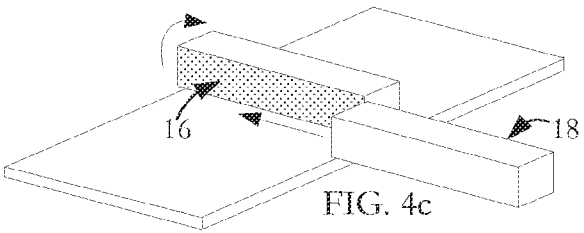
FIG. 4*c* is a view corresponding to FIG. 4*b*, but showing the inkjet print engine, the inkjet printhead maintenance assembly and the sheet media transport mechanism at a subsequent juncture in the maintenance cycle.
Figure 4D:
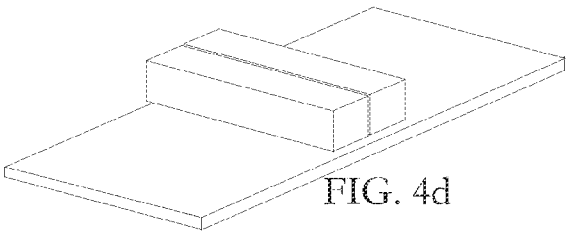
FIG. 4*d* is a view corresponding to FIG. 4*c*, but showing the inkjet print engine, the inkjet printhead maintenance assembly and the sheet media transport mechanism at a subsequent juncture in the maintenance cycle.

A further variation of the FIGS. 2*a* to 2*c* embodiment is shown in FIGS. 4*a* to 4*c*. In this embodiment, during printing, the maintenance assembly 12 is positioned laterally offset from the transport belt 14 as shown in FIG. 4*a*. When a maintenance procedure is to be performed, the print engine 10 is first turned about a hinge mounting 15 to reveal the printhead face 16. Subsequently, the maintenance assembly 12 is moved laterally over the belt 14 so that the active face 16 of the printhead 10 faces the selected element 18 of the maintenance assembly 12.

Figure 5A:
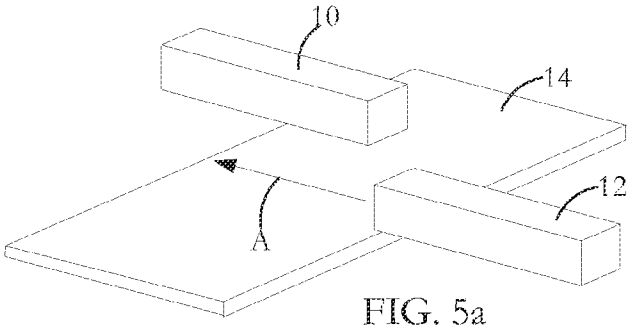
FIG. 5*a* is perspective view of an inkjet print engine, an inkjet printhead maintenance assembly and a sheet media transport mechanism according to a variation of the embodiment of the invention illustrated in FIG. 2*a*.
Figure 5B:
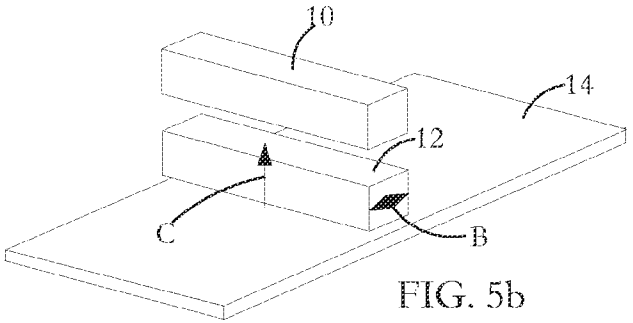
FIG. 5*b* is a perspective view corresponding to FIG. 5*a*, but showing the inkjet print engine, the inkjet printhead maintenance assembly and the sheet media transport mechanism at a subsequent juncture in a maintenance cycle.
Figure 5C:
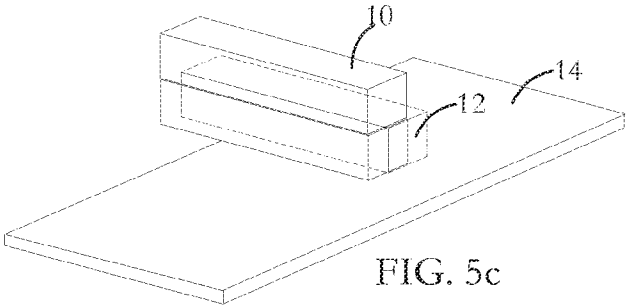
FIG. 5*c* is a view corresponding to FIG. 5*b*, but showing the inkjet print engine, the inkjet printhead maintenance assembly and the sheet media transport mechanism at a subsequent juncture in the maintenance cycle.

While the embodiments of FIGS. 2*a* through 4*c* have been described as involving a single movement of the print engine 10 and a single movement of the maintenance assembly 12, a more complex movement may be implemented in either or both cases to bring a selected maintenance element to an engagement position where it can service the printhead face. Thus, as shown in the example of FIGS. 5*a* to 5*c*, in a first lateral movement A, the maintenance assembly 12 is moved into a space formed by raising the print engine 10. The maintenance assembly 12 is then moved in a movement B in the transport direction to bring a selected one of the maintenance elements under but spaced from the nozzles of the printhead. Finally, the maintenance assembly is moved vertically as shown at C to bring the selected maintenance element against the printhead print face whereupon the selected maintenance element is used in the selected maintenance procedure.

Figure 6:
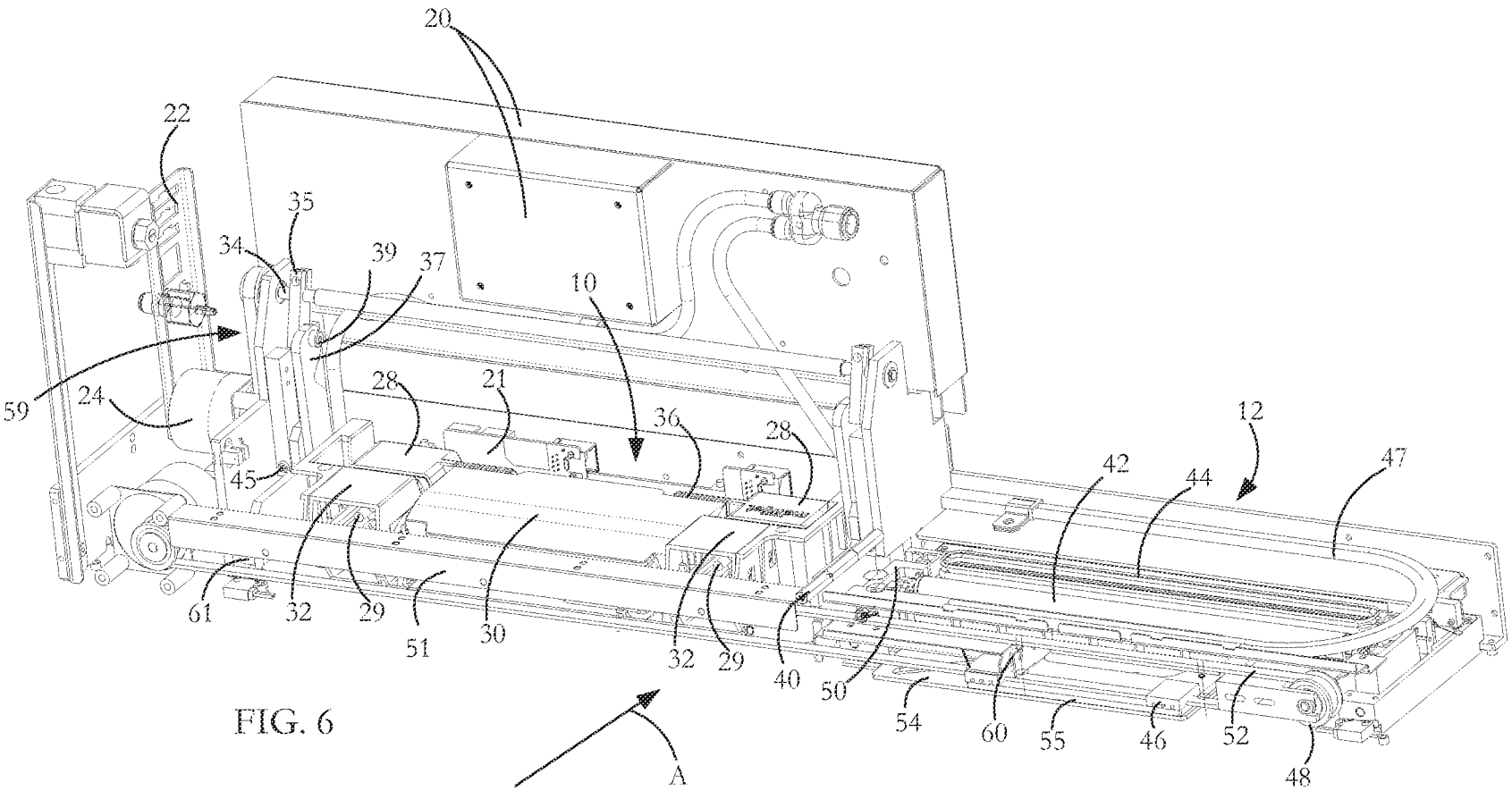
FIG. 6 is a perspective view of a print engine and maintenance assembly arrangement according to an embodiment of the invention.

Referring in detail to FIG. 6, there is shown a more detailed view of the embodiment of FIGS. 5*a* to 5*c* showing specific components of the print engine 10 and the maintenance assembly 12, and showing also how the components interrelate in the course of printing and maintenance cycles.

Figure 7:
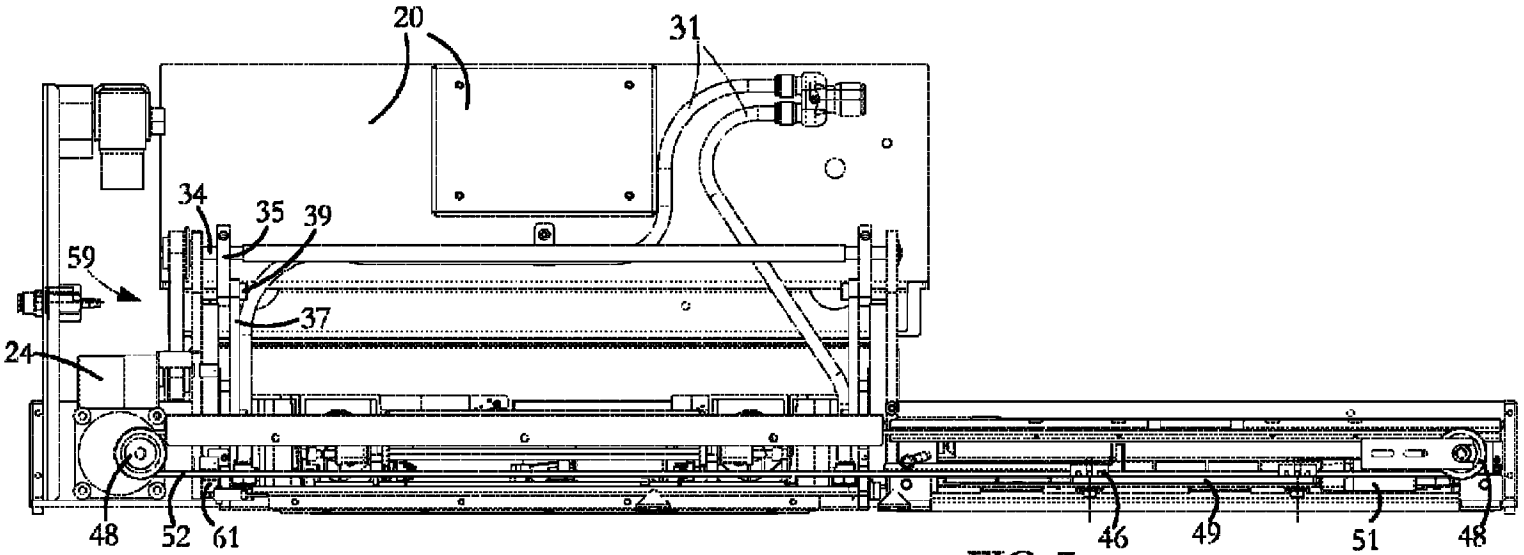
FIG. 7 is a side view of the arrangement of FIG. 6, the arrangement as disposed in readiness for a printing operation.
Figure 8:
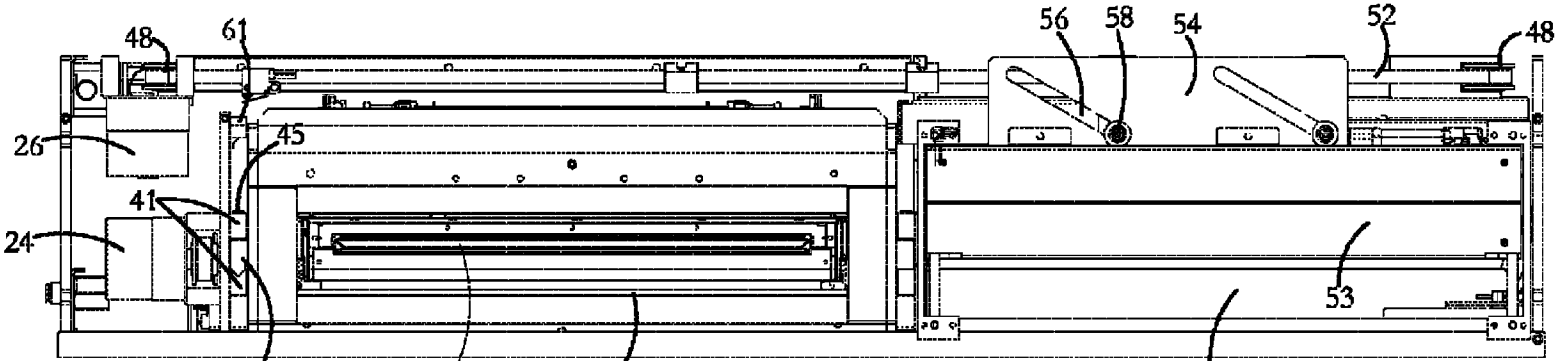
FIG. 8 is a bottom view corresponding to the view of FIG. 7.
Figure 9:
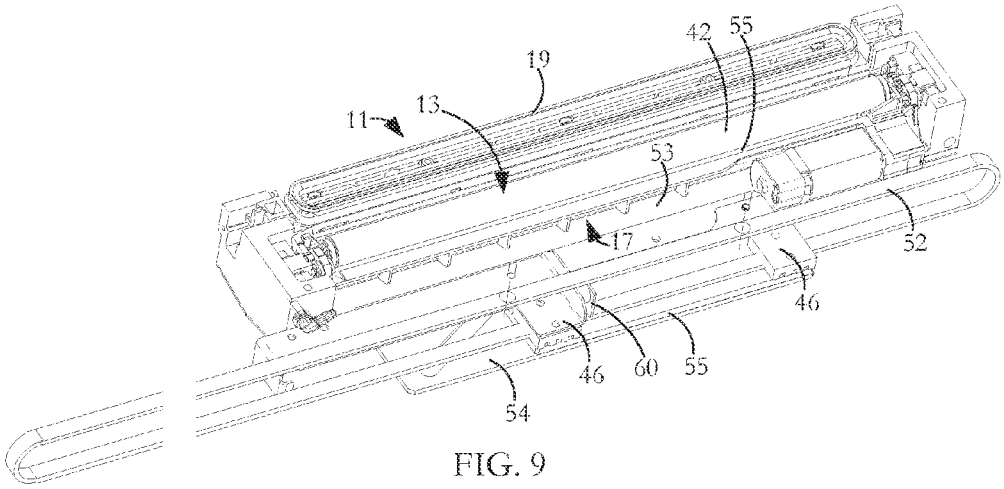
FIG. 9 is a perspective, detail view of certain elements of the arrangement of FIG. 7.

A printhead 36 forming part of the print engine 10 is shown in the printing position in FIGS. 7, 8 and 9 with a top part of the printhead 36 shown behind a locking handle 30. The locking handle 30 is hinged upwardly to an unlocked position to allow insertion and removal of the printhead 36 and then is hinged downwardly to force the printhead 36 down against location hardware which prevents it from moving relative to support structure and which ensures the printhead is accurately positioned relative to reference features of the support structure.

The printhead extends between inlet and outlet manifold connectors 28 located at respective ends of the printhead. The manifold connectors 28 operate to transfer different coloured inks from a series of supply tubes (not shown) to a matrix of channels in the printhead by means of which the inks are delivered to the printhead nozzles. Each of the connectors 28 has a series of stub tubes 29 for the respective inks. To prepare for printing, the printhead 10 is lowered into a pre-lock position and the ink supply tubes having a corresponding manifold connector 28 at their ends are lodged in a guide 32. Operation of the locking handle 30 acts to join the ink supply tubes to the manifold connectors to establish fluid paths for the inks.

Figure 19:
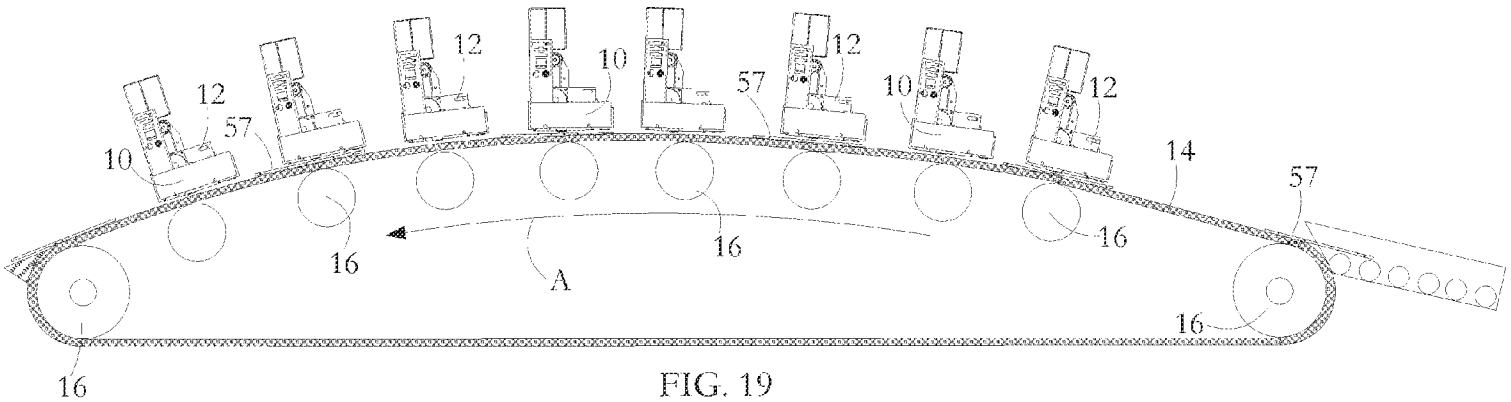
FIG. 19 is a side view showing of several print engine-maintenance assembly combinations according to an embodiment of the invention, the multiple combinations configured for printing and maintenance operations on belt transported sheet media.

The printhead 36, although not illustrated in detail, is a thermal drop-on-demand inkjet printhead manufactured as an integrated circuit device to include heating resistors located adjacent the ink ejection nozzles, the resistors being individually energized by electrical heating pulses in response to an input print signal. For each ink colour or type, a separate ink supply circuit is used having an ink supply container and a peristaltic pump for pumping ink from the container to the printhead. For each ink, the printhead has an inlet port, an ink outlet and a main channel. Ink is drawn from the main channel into branch channels by capillary action to replace ejected ink. Printing is enabled by "firing" selected nozzles at the printhead active face. Ink in the nozzle chamber is prevented from escaping from the nozzle and flooding the nozzle plate by maintaining a negative hydrostatic pressure at the printhead. As shown in FIG. 19, the printer has several printheads each having a nozzle density of the order of 1600 dots per inch (dpi). A series of such integrated circuit devices is combined to provide a page wide printhead having five colour channels. Although the figures illustrate a thermal drop-on-demand printhead, it will be appreciated that alternative forms of inkjet printhead can be deployed.

As illustrated in FIGS. 6 to 15 other standard operational elements are associated with the print engine 10. Thus, printed circuit assemblies for controlling the motors 24 and 26 are contained in casings 20. A further printed circuit assembly for controlling operation of the printhead nozzles is contained in the casing 21. A bracket 22 is provided for suspending and guiding cable connections such as those linking the printed circuit boards 20, 21 to power supplies. A conduit 47 houses a waste ink tube for transferring ink from the spittoon to a recycling tank. The conduit 47 also houses cabling for powering a motor to drive rollers 42. It is necessary that the gap between the inkjet printhead face 16 and the surface of a sheet medium on which an image is being printed should be clear of any ink other than ink which is to contribute to the intended image. In particular, it is desirable that there be no fine mist which might adversely affect print quality if it settles on the sheet medium outside the confines of the intended image. To reduce the incidence of such a mist, the print head is connected to a vacuum unit (not show) which is operated to deliver suction through a coupling and tubes 31 located each side of the array of printhead nozzles. The chambers open to a slot 33 close to the array of nozzles through which mist developed outside the printing zone is sucked away.

Figure 12:
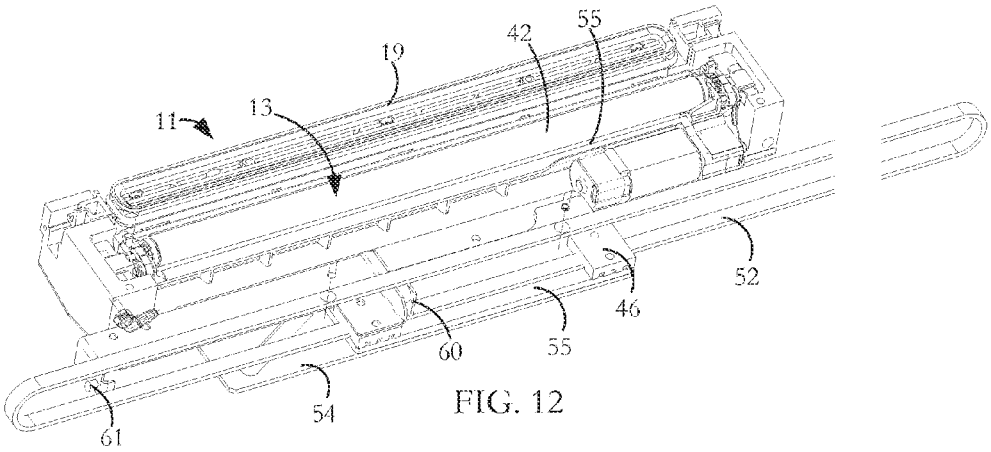
FIG. 12 is a perspective, detail view of certain elements of the arrangement of FIG. 10.
Figure 15:
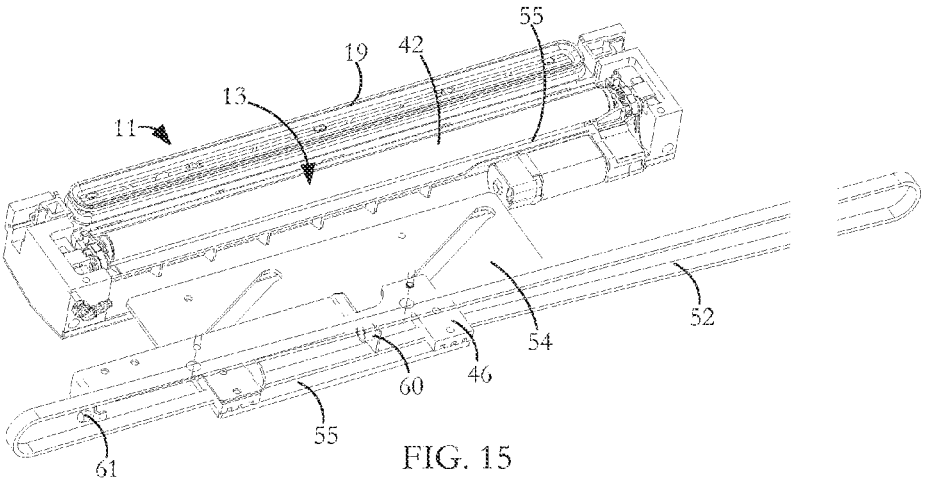
FIG. 15 is a perspective, detail view of certain elements of the arrangement of FIG. 13.
Figure 13:
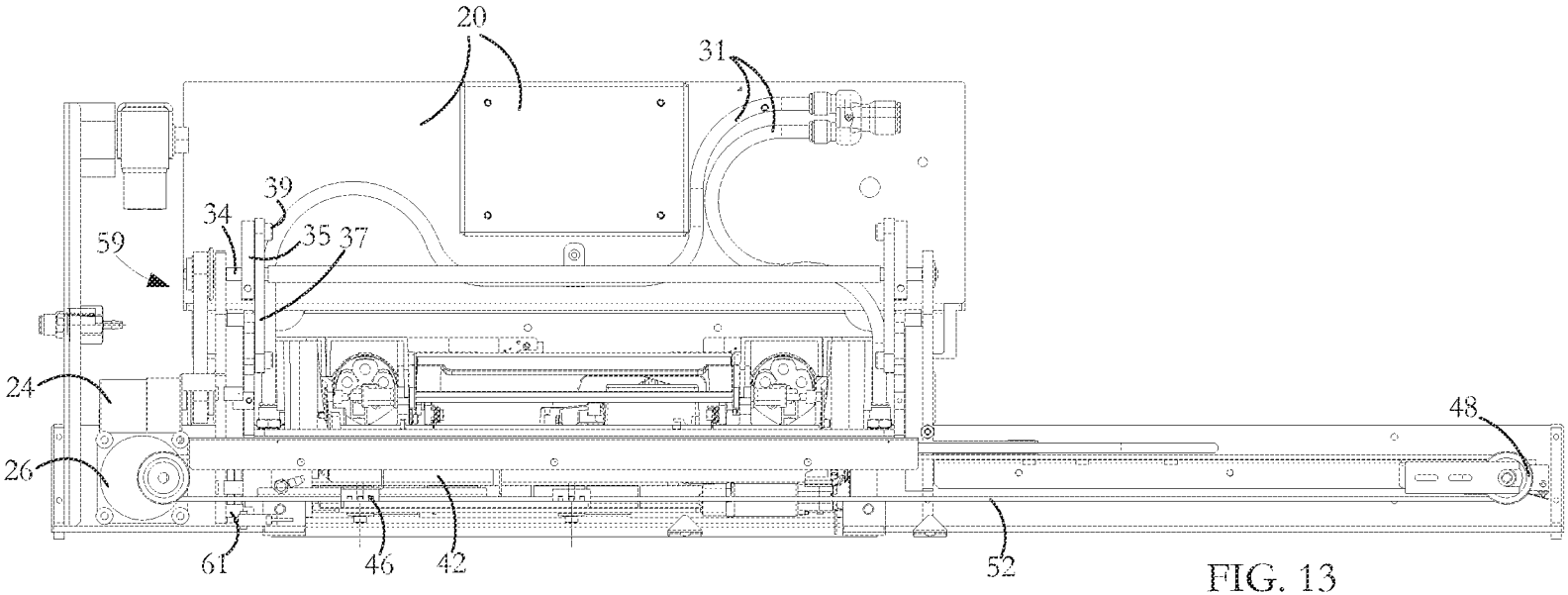
FIG. 13 is a side view of the arrangement of FIG. 6, the arrangement as disposed in readiness for a cleaning operation.
Figure 14:
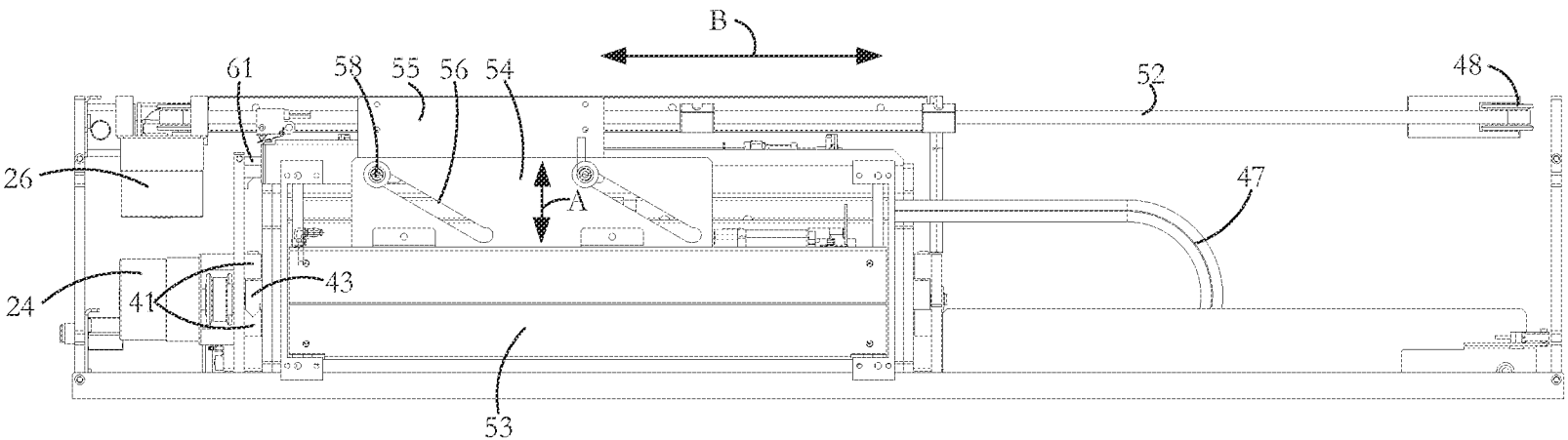
FIG. 14 is a bottom view corresponding to the view of FIG. 13.

The printhead 36 is mounted in a support structure which includes a carriage 59 for moving the printhead 36 up and down between a lowered position for printing (FIGS. 7, 8, 9) and a raised position for capping (FIGS. 10, 11, 12) and cleaning (FIGS. 13, 14, 15). A print engine drive motor 24 is connected though a timing belt to a shaft 34. Rotation of the shaft 34 turns a motion transfer arm 35 about the shaft axis. The motion transfer arm 35 is mounted to a link element 37 at a bearing 39. The link element 37 is mounted to the printhead support structure at a bearing (not shown) and functions to raise and lower the printhead. Guide members 41 flank a slide member 43 connected to the casing of the printhead 36 to accurately guide the printhead as it is lowered to the printing position. The printhead casing is biased by a spring mounted piston 45 against one of the guide members as the printhead is lowered to its printing position to ensure minimal tolerance in the printhead printing position.

In the raised printhead position (FIGS. 10, 11, 12), the motion transfer arm 35 is positioned so that the bearing 39 is located vertically above the axis of the shaft 34 which means that the printhead is not dislodged by the weight of the printhead assembly, but needs a positive rotation of the shaft 34 to permit downward movement of the printhead from the raised, maintenance position.

The maintenance assembly 12 has three primary components: a capper 11, a cleaner 13 and a spittoon 17, these components being mounted on a maintenance tray 53.

The capper 11 has the form of an elongate trough, with a wall of the trough terminating at a gasket 19. The capper 11 is deployed to cover nozzle orifices at the printhead active face 16 following a preset period after printing ceases. In the capped position, the nozzles are not exposed to the atmosphere which could otherwise lead to rapid drying of ink retained in the nozzles. This might in turn lead to partially or fully blocked nozzles and consequently inferior print quality. With the capper 11 in place against the printhead active face, drying air currents are prevented from circulating in the region of the nozzles.

The cleaner 13 comprises a flexible cellular foam cleaning roller 42 mounted on a drive shaft and a parallel idler steel roller mounted against the roller 42 so that it protrudes into the surface of roller 42 so as to cause localized deforming of the flexible cellular foam. The foam and steel rollers are used in a cleaning sequence as follows. Ink is first pumped through the nozzles of the printhead 36 to flood its active face 16. The foam roller 42 is then rotated against the printhead active face to cause the foam roller to pick up flooded ink. The turning of the foam roller 42 against the steel roller initially acts to distribute the ink throughout the foam roller. As the foam roller 42 continues to turn the ink-saturated foam slides across the printhead active surface to wash it. Further rotation of the foam roller 42 against the steel roller 55 after the supply of washing ink to it has stopped acts to clean the foam roller by squeezing the ink contained within it out of the roller so that it drops into the spittoon 17.

Figure 20:
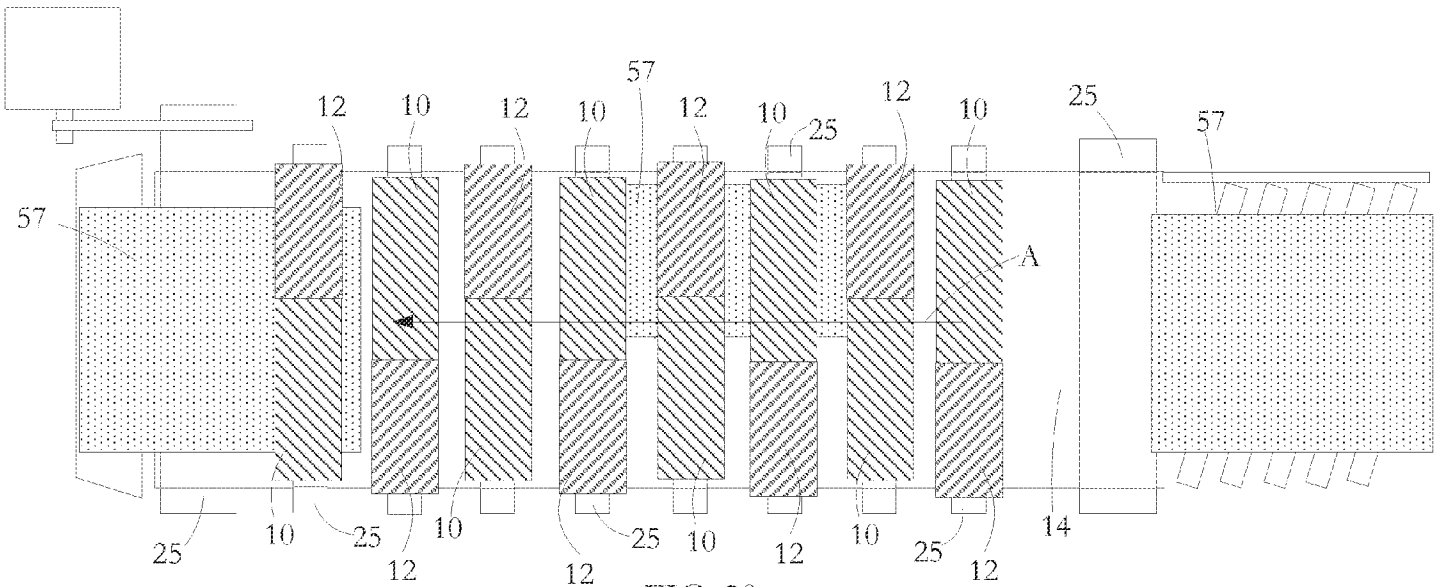
FIG. 20 is a plan view of the arrangement of FIG. 19.

As previously indicated, the maintenance assembly 12 and its operation are particularly, but not exclusively, applicable to a printing apparatus and operation as described in copending U.S. patent application Ser. No. 13/368,280 and as illustrated in FIGS. 19 and 20. In this apparatus, sheet media 57 are transported on a continuous belt 14. Consequently, for capping and cleaning purposes, a conventional sequence where a printhead remains in place after printing is stopped and a maintenance assembly is brought up to the printhead cannot be adopted. The presence of the belt 14 precludes the maintenance elements being brought up to the printhead.

When the apparatus of FIG. 6 is in the process of printing, the sheet conveyor belt (not shown) is driven in the direction of arrow A to transport sheet media to a position under the printhead 36. During printing, the maintenance assembly 12 is positioned offset to one side of the conveyor belt. A print run continues until suspended either for performance of a maintenance function, such as cleaning the printhead, or because the particular print run is ended. In both cases, after printing is stopped, the printhead is raised to create a space between the printhead active face 16 and the media conveyor belt. The maintenance tray 53 supporting the capper 11, cleaner 13 and spittoon 19 is then slid into position under the printhead 36. In the case of any interruption in the print run, the tray 53 is moved to a position in which the capper 11 can be placed over the printhead nozzles to prevent them from drying out. In the case of cleaning, the tray 53 is moved to a position in which the cleaner 13 can operate on the printhead active face 16. As shown by the underneath view of FIG. 21, the maintenance tray 53 has runners 49 which slide in corresponding guides 51 of the support structure. The tray 53 is driven by a continuous timing belt 52 mounted between pulleys 48 and driven by motor 26 to slide the tray 53 to left and right as shown in FIG. 6.

Figure 21:
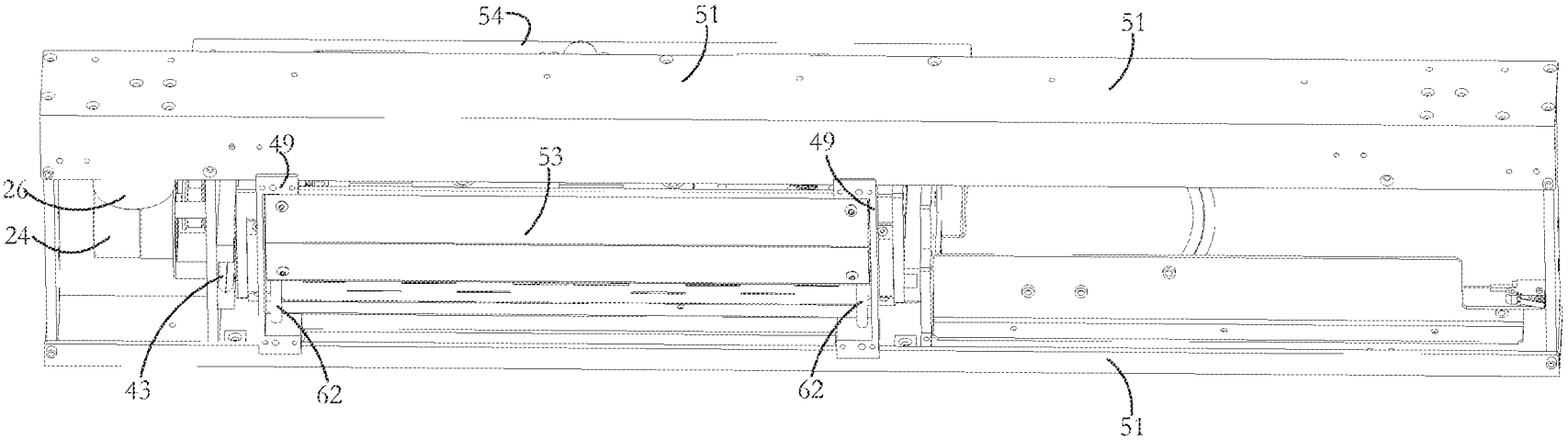
FIG. 21 is a view from underneath and one side showing a maintenance assembly tray and its mounting arrangement according to an embodiment of the invention.

The belt is attached by clamping blocks 46 to a motion transfer mechanism including plates 54 and 55. The blocks 46 are attached directly to the plate 55 which is reciprocally driven by the belt 52 in direction B transverse to the direction of travel of the sheet media. The plate 55 is mounted to motion transfer plate 54 by pins 58 projecting from plate 55 engaging in diagonally extending slots 56 formed in plate 54. The pins 58 are retained in the slots 56 but are free to slide along them. The plate 54 is fixed to the maintenance tray 53. The mounting arrangement is used to impart a compound motion to the tray 53 comprising reciprocal motion in direction B to transfer the maintenance tray 53 between the printing position of FIGS. 7, 8, 9 and the capping position of FIGS. 10, 11, 12, and reciprocal motion in direction A to transfer the maintenance tray between the capping position and the cleaning position of FIGS. 13, 14, 15. The reciprocal movement of the tray 53 in direction A occurs in response to movement of the pins 58 along the diagonal slots 56. As shown in FIG. 21, movement of the tray 53 is guided by the sliding engagement of rods 62 within respective cylindrical bores (not shown) in the support structure. Transition from the tray 53 moving in the direction B (or its reverse) to the tray moving in direction A (or its reverse) is triggered by the release of one or other of pair of the magnetic latches 60, 61, the positions and operation of which are best viewed with respect to FIGS. 9, 12 and 15.

Figure 10:
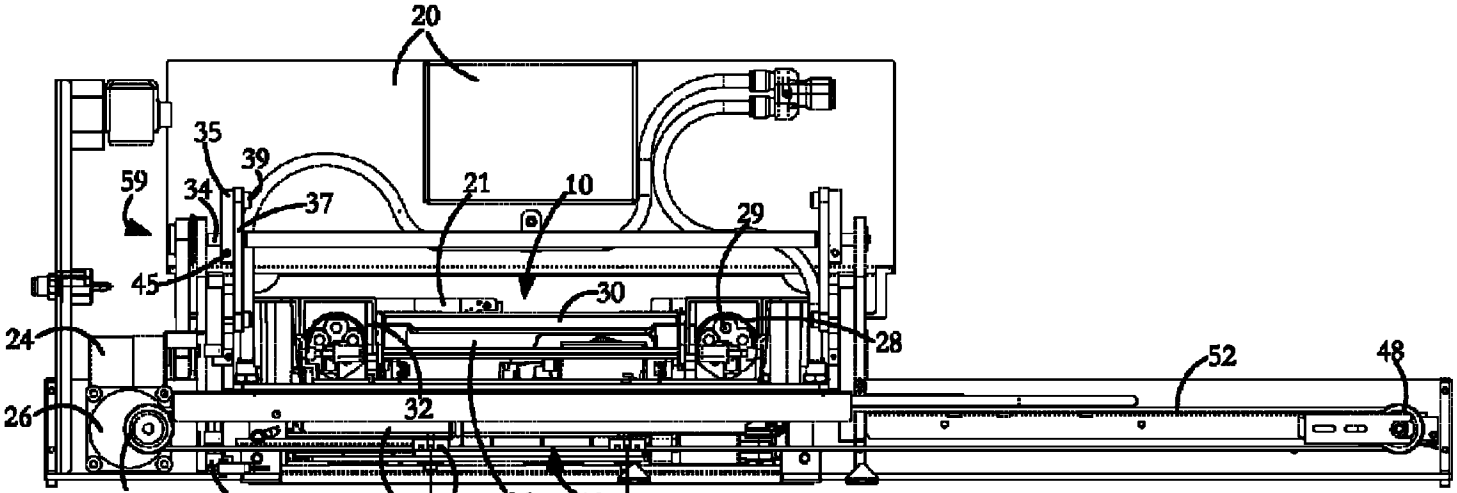
FIG. 10 is a side view of the arrangement of FIG. 6, the arrangement as disposed in readiness for a capping operation.
Figure 11:
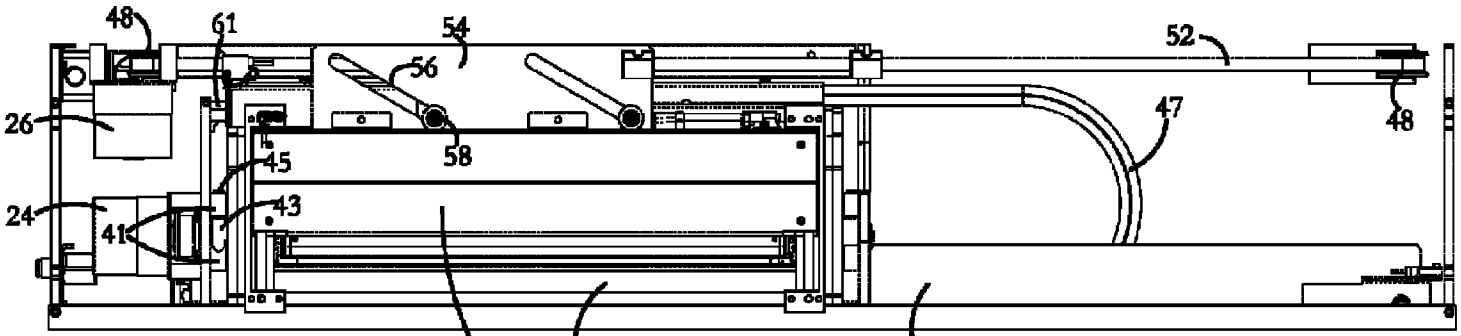
FIG. 11 is a bottom view corresponding to the view of FIG. 10.

From the printing position of FIGS. 7, 8, 9, when the tray is to be moved to the capping position, FIGS. 10, 11, 12, initial drive from the belt 52 serves solely to drive the tray 53 in the direction B because the tray is held against movement in the direction A by the magnetic latch 60. Once the tray 53 reaches a limiting position corresponding to the cleaning position, it attaches to magnet 61. Further movement of the belt drives the pins 58 along slots 56 in the course of which the magnetic latch 60 is forced open and plate 53 moves in direction A to capping position. In the maintenance positions, the tray 53 is at the extreme left hand position shown in FIGS. 10 to 15 and reciprocal drive from belt 52 in direction B (or its reverse) serves solely to drive the tray 53 in the A direction (or its reverse) between the capping position and the cleaning position. In the maintenance positions, the tray 53 is held against movement in the reverse B direction by magnetic latch 61 until the pins 58 reach right hand limiting positions in the slots 56; i.e. starting in the FIG. 14 position and ending in the FIG. 11 position. At that point the magnetic latching of latch 60 is engaged and that of 61 is broken and further drive from the belt 52 moves the tray 53 in the reverse B direction.

At the capping position, FIGS. 10 to 12, the capper 11 is located directly below the active face of the printhead 36. If the printhead is to be temporarily capped, once the capper 11 is in place, the motor 24 is operated to drive the printhead 36 down onto the capper. The capper is slightly longer than the length of the array of printhead nozzles and at its upper edge, the deformable gasket 19 seals against the printhead active face 16 as the printhead 36 is lowered into position.

At the cleaning position, FIGS. 13 to 15, the printhead 36 is positioned directly over the cleaning roller 42 and to initiate cleaning, the printhead is lowered onto the cleaning roller by further operation of the printhead motor 24. Ink is then pumped through the printhead nozzles to flood its active face 16. The foam roller 42 then rotates against the printhead to pick up the flooded ink, rotates against the steel roller to distribute the ink throughout the roller 42, rotates against the printhead to wash its active face in the flooded ink, and continues to rotate against the steel roller after the supply of washing ink is stopped to squeeze excess ink from the roller 42 so that it drops into the spittoon 17.

As indicated previously, and with reference to FIGS. 19 and 20, the print engine 10 is one of a number of print engines arrayed in the transport direction A above a paper sheet transfer belt. The printheads of the print engines 10 are closely spaced in the transport direction A so as to limit the transport span needed to accommodate them which means that the maintenance assemblies 12 and their support structure must be compact. The above described mechanism for implementing a two phase motion contributes to such compactness. As shown in FIGS. 19 and 20, the print engines 10 are arrayed in two banks of four, each bank occupying a respective side of the belt 14 which is driven around an array of rollers 25. The print engines 10 of one bank are staggered relative to the print engines 12 of the other bank. This design is of value because, whereas most printing jobs will require operation of only one bank of print engines to print a full page wide image on for example an 8.5 inch by 11 inch sheet, an occasional print job will require operation of both banks of print engines to print a page width up to 17 inches. It will be appreciated that by limiting the width of the maintenance assemblies 12 to about the width of the print engines 10, when the apparatus is in a printing mode, the maintenance assembly 12 associated with one print engine 10 in one of the banks of print engines occupies a position directly laterally of the associated print engine but parked snugly between two adjacent print engines 10 of the other bank of engines. It will be appreciated, however, that other arrangements of multiple print engines can be deployed using the principles of the invention.

Figure 16:
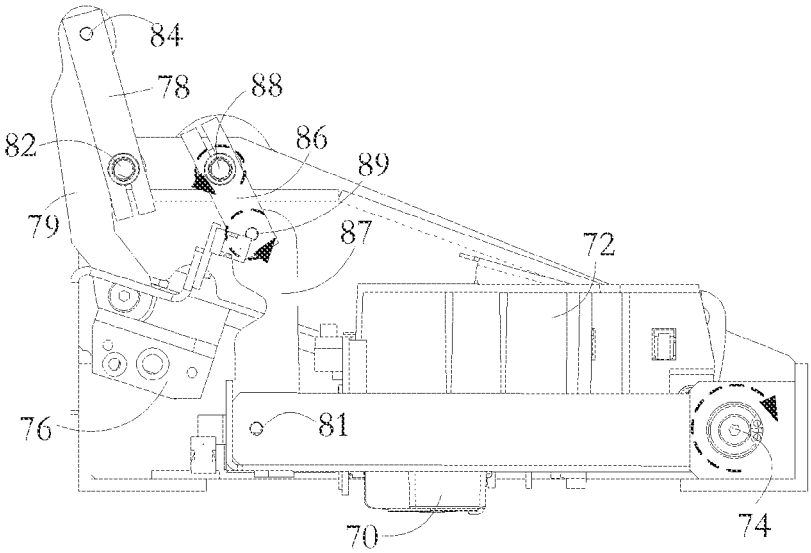
FIG. 16 is a side view of a print engine and maintenance assembly arrangement according to another embodiment of the invention
Figure 17:
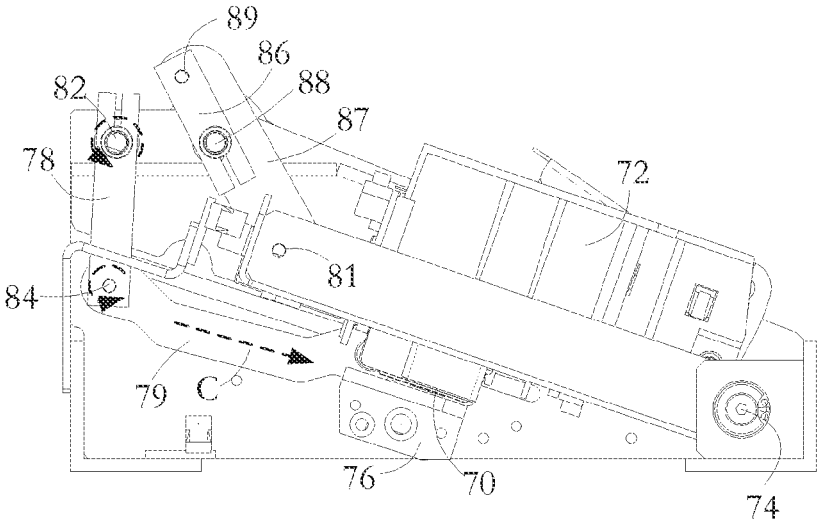
FIG. 17 is a side view corresponding to the view of FIG. 16 but showing the arrangement in a different operating phase.
Figure 18:
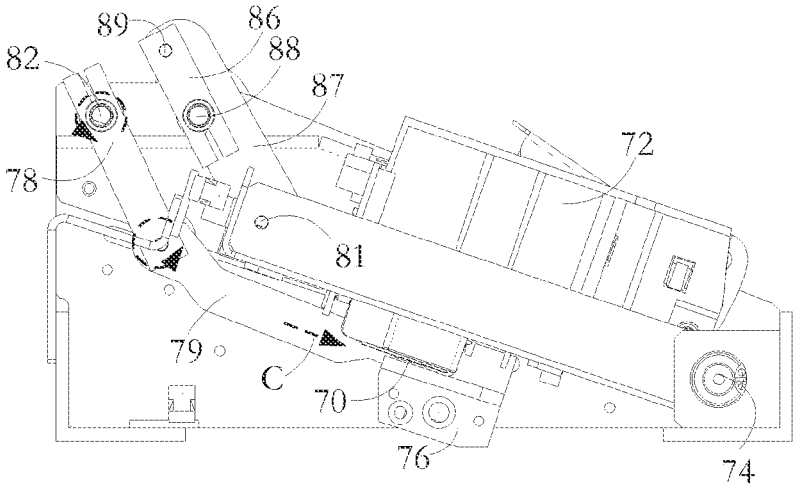
FIG. 18 is a side view corresponding to the view of FIG. 16 but showing the arrangement in another operating phase.

An alternative embodiment is shown in FIGS. 16 to 18, where FIG. 16 shows the arrangement in printing mode, FIG. 17 shows the arrangement in capping mode, and FIG. 18 shows the arrangement in cleaning mode. In these three figures, principles of the invention are evident insofar as a printhead 70 is moved out of the position shown in FIG. 16 to open up a space, the maintenance assembly is moved into the space for capping, and is moved further for cleaning. However, in the arrangement shown in these figures, as modeled in FIGS. 3*a*-3*c*, the print engine is angularly rotated through one movement to present the space and the maintenance sled is then angularly rotated into the space to position the maintenance components for the maintenance operations. Referring in detail to FIG. 16, the printing apparatus has a printhead 70 which during printing is positioned as shown for printing on an underlying print medium. The printhead has an associated printhead locator 72 for effecting precise registration of the print head relative to the media, the printhead locator being mounted to a support structure at a bearing pivot 74. The printhead locator 72 is mounted at pivot 81 to a linkage 87 which is pivotally mounted to a print engine driving arm 86. The driving arm 86 is driven around bearing pivot 88 to cause the linkage 87 to lift the printhead locator and to cause the printhead to hinge from the position shown in FIG. 16 to the position shown in FIG. 17.

Also mounted to the support structure is a maintenance assembly 76 having a capper, a cleaner and a spittoon. The maintenance assembly 76 is mounted at the end of a linkage 79 which is pivotally mounted at bearing pivot 84 to a maintenance assembly driving arm 78 which is itself mounted to the support structure at pivot point 82. The driving arm 78 is driven about pivot 82 to effect corresponding translational movement and pivoting of the linkage 79 about bearing pivot 84 which causes the maintenance assembly to move reciprocally along path C depending on which way the driving arm 78 is driven.

In use, when a maintenance operation is to be performed, printing is stopped and by operation of driving arm 86, the print engine is pivoted about pivot point 74. This leaves a space under the printhead 70. The driving arm 78 is then actuated to drive the maintenance assembly 76 in direction C under the printhead 70 for capping (FIG. 17) or for cleaning (FIG. 18).

Other variations and modifications will be apparent to those skilled in the art. Although the embodiments of the invention described and illustrated have particular application to non-scanning printheads such as are commercially available under the MEMJET registered trade mark, it will be appreciated that other non-scanning and scanning printheads could advantageously be used with the invention. The embodiments of the invention described and illustrated are not intended to be limiting. The principles of the invention contemplate many alternatives having advantages and properties evident in the exemplary embodiments.

What is claimed is:

1. Apparatusas comprising a printhead mounted on a first carriage, a printhead maintenance assembly including first and second maintenance elements, the printhead maintenance assembly mounted on a second carriage, a transport assembly operable to move sheet media past the printhead in a transport direction along a transport path for printing thereon by the printhead, a first reciprocal drive to drive the first carriage between a first position in which the printhead is positioned for printing onto sheet media in the transport path, and a second position in which a space is established between the printhead and the transport path, a second reciprocal drive for driving the second carriage to effect a first phase movement of the second carriage between a third position in which the maintenance assembly is parked at a position allowing printing of transported sheet media by the printhead and a fourth position in which the maintenance assembly occupies the space and the first maintenance element is positioned for performing a maintenance operation on the printhead, and a second phase movement of the second carriage between the fourth position and a fifth position in which the first maintenance element is displaced from its operating position relative to the printhead and the second maintenance element is located in an operating position relative to the printhead, the second reciprocal drive being a belt drive, the belt drive for reciprocally driving the second carriage in a first direction, the belt connected to a motion transfer device to convert a predetermined movement of the belt to movement of the second carriage in a direction transverse to the first direction.

* * * * *